US007424912B2

(12) United States Patent
Reid

(10) Patent No.: US 7,424,912 B2
(45) Date of Patent: Sep. 16, 2008

(54) WELLBORE TREATMENT APPARATUS AND METHOD

(75) Inventor: Paul Reid, Tavistock (GB)

(73) Assignee: Schlumberger Technology Corporation, Cambridge, MA (US)

( * ) Notice: Subject to any disclaimer, the term of this patent is extended or adjusted under 35 U.S.C. 154(b) by 66 days.

(21) Appl. No.: 11/618,091

(22) Filed: Dec. 29, 2006

(65) Prior Publication Data

US 2008/0156535 A1 Jul. 3, 2008

(51) Int. Cl.
*E21B 43/25* (2006.01)
*E21B 47/08* (2006.01)

(52) U.S. Cl. ..... 166/255.1; 166/64; 166/305.1; 166/223

(58) Field of Classification Search ..... 166/255.1, 166/223, 250.01, 305.1, 64, 66; 73/152.17, 73/152.46, 152.54
See application file for complete search history.

(56) References Cited

U.S. PATENT DOCUMENTS 1,427,944 A * 9/1922 Crotto ..... 166/223
2,639,512 A 5/1953 Legrand
2,725,282 A * 11/1955 Buckley et al. ..... 422/82.12
4,302,881 A * 12/1981 Schwind et al. ..... 33/544.3
4,941,350 A * 7/1990 Schneider ..... 73/152.24
5,445,220 A * 8/1995 Gurevich et al. ..... 166/55
6,923,052 B2 * 8/2005 Krueger et al. ..... 73/152.22
7,069,775 B2 7/2006 Fredette et al.
2006/0249307 A1 * 11/2006 Ritter et al. ..... 175/40

* cited by examiner

*Primary Examiner*—Hoang Dang
(74) *Attorney, Agent, or Firm*—Steven Gahlings, Esq.; Jim McAleenan, Esq.; Jody Lynn DeStefanis, Esq,

(57) ABSTRACT

A treatment apparatus and method for wellbore instability is described including a caliper with one or more radially extending arms which are capable of extending and retracting movement in a radial direction and a fluid supply facility to deliver treatment fluid from the ends of the arms to the wellbore wall, with a sensing and valve mechanism such that in use fluid is being delivered from the end of any extended arm to a breakout region of the wellbore where there is instability.

14 Claims, 1 Drawing Sheet

WELLBORE TREATMENT APPARATUS AND METHOD

BACKGROUND

This invention relates to apparatus for and a method of treating wellbores, particularly treatments to reduce or prevent wellbore instability.

Various caliper tools for gauging the diameter of a borehole are known in the art. In one example, a caliper tool includes one or more bow springs coupled to a tool body. When the tool body is disposed in a borehole, the bow spring engages the borehole wall and expands and contracts as the tool body traverses the borehole and the borehole diameter changes. The motion of the bow spring can provide an indication of the borehole diameter. In this case, a sensing device can be attached to the bow spring and used to monitor the motion of the bow spring. This is taught, for example, in U.S. Pat. Nos. 2,639,512 and 7,069,775 B2. Some caliper tools further include one or more rigid arms coupled between the tool body and the bow spring. The rigid arm deflects as the bow spring expands and contracts, and the motion of the rigid arm provides an indication of the borehole diameter.

Wellbore instability takes many forms, can have several causes and may be treated in many ways. Uneven earth stresses and specific rock properties can combine to cause breakouts in a wellbore (i.e. the cross-section of the wellbore is enlarged along one axis while the rest of the borehole remains in-gauge or near to gauge). In drilling the overburden, this phenomenon can lead to major well construction problems including stuck pipe and poor zonal isolation. In a reservoir, the same problems can occur as in the overburden, but the additional inconvenience of sand production can also take place, sometimes throughout the life of the well.

Known wellbore treatment methods can be mechanical, e.g, setting a sacrificial casing string or expandable tubular, sand screen etc., chemical, e.g. injection of resins to consolidate sand, changes in the drilling fluid chemistry to prevent further instability etc., or Theological, e.g. by placing gels into the wellbore to stabilize fractured rock and similar methods.

These treatments meet with varying degrees of success, but are generally applied to the whole wellbore within a defined depth range. Preserving formation permeability can be important (for instance in a producing reservoir), but this is more often than not severely compromised by current treatments, or an additional step of perforating past the treatment is required to re-establish the wellbore-reservoir connection.

SUMMARY OF THE INVENTION

According to one aspect of the invention, there is provided an apparatus for treating a wellbore instability including a caliper with a plurality of radially extending arms which are capable of extending and retracting movement in a radial direction, a fluid supply for delivering treatment fluid from at least of the arms to the wellbore, whereby in use the ends of the caliper arms engage the wellbore, and the fluid being delivered from the arm or arms so that the fluid is applied to regions of the wellbore.

In the pre-completion phase of well construction, a caliper log can be run to give data on the depth range, magnitude and orientation of any breakouts. These data can be used to modify future drilling and completion programs. The caliper for producing a caliper log can be modified to incorporate the facility for delivering treatment fluid to any extended arms of the caliper, to put the invention into effect.

Preferably, the fluid supply includes a valve mechanism for delivering treatment fluid. More preferably, the valve mechanism allows fluid delivery from the end of an extended arm but blocks fluid delivery from a non-extended arm.

In an even more preferred embodiment the radially outer end of each caliper arm may have an outlet port for delivering the treatment fluid, and the sensing and valve mechanism may include a valve for each arm and may be operative to sense an extended condition of any arm so as to open the corresponding valve.

The treatment fluid can be held in a fluid reservoir which forms part of the calliper tool or any conveyance tool. Alternatively, the fluid may be held in a surface reservoir and delivered to the caliper at a down hole location via a tube along or within the conveyance tool. The treatment fluid itself can be for example a chemical resin or a gel.

Preferably, the caliper is mounted on a wellbore conveyance tool such as a wireline, a drill pipe or a coiled tubing. If mounted on a drill pipe or coiled tubing, the caliper tool is preferably mounted for a rotation independent of the drill pipe or coiled tubing. The caliper may have two, three, four or more extendible arms, which are more preferably equi-angularly spaced.

According to another aspect of the invention there is provided a method of treating wellbore instability, the method comprising rotating within the wellbore a caliper having a plurality of radially extending arms which are capable of extending and retracting in a radial direction as ends of the arms engage the wellbore so that any arm encountering a breakout region, where the wellbore is enlarged, is extended and tends to become located in said region, and delivering treatment fluid to the ends of any extended arm from which the fluid is applied to the breakout regions in order to stabilise the latter.

Aspects and embodiments of the present invention will now be illustrated, by way of example, with reference to the accompanying figures. In the following further aspects and embodiments of the present invention will become apparent to those skilled in the art.

BRIEF DESCRIPTION OF THE DRAWINGS

The present disclosure is described in conjunction with the appended figures.

DETAILED DESCRIPTION AND EXAMPLES

Figure 1A:
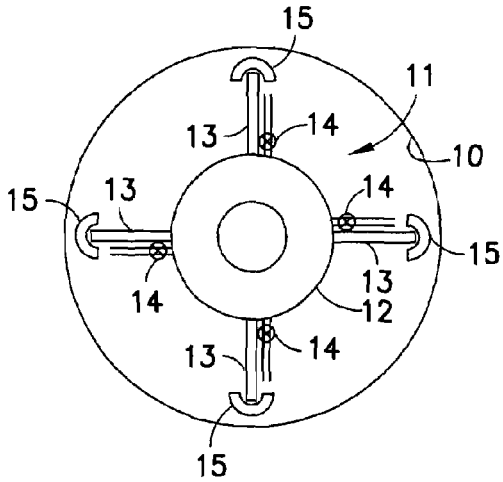
FIG. 1A is diagrammatic view of the apparatus with caliper arms of the apparatus in a retracted condition.

In FIG. 1A, a caliper 11 is rotatably mounted on a drill pipe or coiled tubing 12. The caliper 11 has a central hub and four equi-angularly spaced and radially extending arms 13, each of which is capable of extension and retraction in a radial direction. The arms 13 are biased towards their extended positions so that the radially outermost ends 15 of the arms engage the inner wall of a wellbore 10 being drilled, this bias conveniently being achieved by fluid pressure transmitted down the drill pipe or coiled tubing 12. The caliper hub and arms are free to rotate with respect to the drill pipe or coiled tubing 12 so that the caliper is capable of occupying an angular orientation independent of the drill pipe or coiled tubing. For this purpose, the caliper hub may be mounted on the drill pipe or coiled tubing by roller bearings.

Figure 1B:
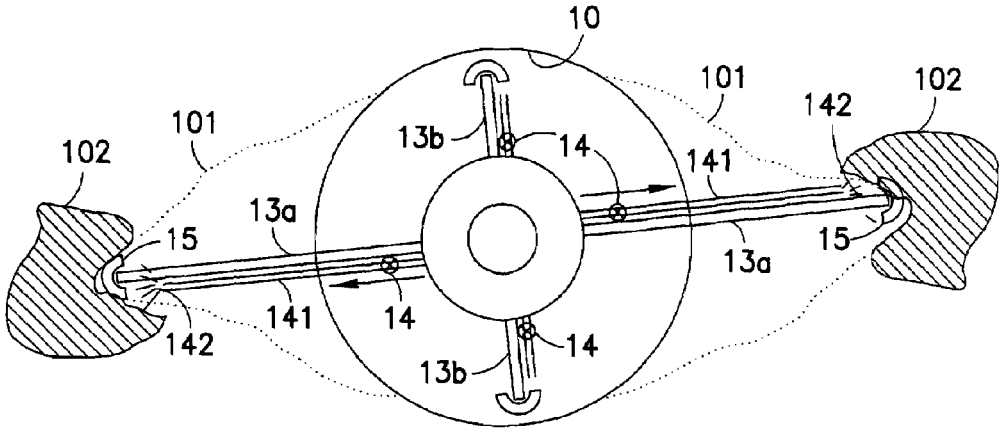
FIG. 1B is a diagrammatic view of the apparatus with a pair of the caliper arms in an extended condition, engaging breakouts in a wellbore.

The wellbore 10 is shown in-gauge (i.e. at the desired diameter) in FIG. 1A. However, wellbore instability can cause breakouts (i.e. enlargements in the cross-section or shape of the wellbore) and FIG. 1B illustrates two breakouts 101 causing enlargement of the wellbore along one axis, with the remainder of the borehole remaining in-gauge. The breakout regions 101 terminate in regions 102 of instability and one pair of caliper arms 13*a* will tend to be positioned along the axis of enlargement with the ends of this pair of arms in engagement with the regions of instability. The other pair of arms 13*b* are not extended and remain in contact with the in-gauge portion of the wellbore.

If there is anisotropic stress in a wellbore, the resulting breakouts are often in a particular plane, and a four arm caliper will tend to orient itself such that at least one of the arms locates in the largest dimension (i.e. within the breakout) where the rock is least stable and may be continuing to fail with time. Failure of the rock could be as blocks or other large fragments or, in the case of some sandstones, as individual sand grains. Without treatment, these pieces or grains are removed from the breakouts (either by falling into the hole or being carried out by fluid flow), so there is the potential for the failed zone to continue to grow. The invention enables the failed blocks or grains to be secured in place, to stabilise the wellbore.

At the hub of the caliper is a sensing and valve mechanism 14 which is operative to sense the extension of any of the four arms and, when an extension is sensed, to direct treatment fluid (e.g. a chemical resin or gel) along the extended arm 141 as indicated by the arrows. The fluid is delivered through an outlet port 142 at the radially outermost end 15 of each extended arm 13*a* which may be tubular or telescopic for this purpose. The fluid is thereby injected under pressure into the regions 102, thereby stabilizing the regions 102 and preventing enlargement of the breakout. Thus, in the example of FIG. 1B, the sensing and valve mechanism 14 causes treatment fluid to be delivered from the ends of the extended arms 13*a* and injected into the regions 102.

While the invention has been described in conjunction with the exemplary embodiments described above, many equivalent modifications and variations will be apparent to those skilled in the art when given this disclosure together with the documents mentioned herein, which are all incorporated herewith by reference. Accordingly, the exemplary embodiments of the invention set forth above are considered to be illustrative and not limiting. Various changes to the described embodiments may be made without departing from the spirit and scope of the invention

What is claimed is:

1. An apparatus for treating a wellbore comprising:

(a) a caliper with one or more radially extending arms which are capable of extending and retracting movement in a radial direction and detecting an inner diameter of the wellbore, and (b) a fluid delivery mechanism capable of delivering fluid to a wall of the wellbore from at least one of said one or more radially extending arms.

2. The apparatus of claim 1 wherein the fluid delivery mechanism is designed to deliver fluid to extended arms.

3. The apparatus of claim 1 wherein the fluid delivery mechanism is designed to deliver fluid to extended arms and block fluid delivery to retracted arms.

4. The apparatus of claim 1 wherein the fluid delivery mechanism includes one or more valves.

5. The apparatus of claim 1 being mounted on a wireline, drill string or coiled tubing.

6. The apparatus of claim 5 being mounted on a drill pipe or coiled tubing for rotation independent of the drill pipe or coiled tubing.

7. The apparatus of claim 1 having fluid outlet port for delivering the treatment fluid located in proximity to the radially outer end of the one or more arms.

8. The apparatus of claim 1 comprising a sensing and valve mechanism operative to sense an extended condition of any arm so as to open a valve corresponding to an extended arm.

9. The apparatus of claim 1 wherein the caliper has four equi-angularly spaced arms.

10. The apparatus of claim 1 further comprising a downhole fluid reservoir.

11. The apparatus of claim 1 further comprising a tubular connection to connect to a remote fluid reservoir.

12. A method of treating wellbore instability, the method comprising rotating within the wellbore a caliper having one or more radially extending arms which are capable of extending and retracting in a radial direction as ends of the arms engage the wellbore so that any arm encountering a breakout region, where the wellbore is enlarged, is extended and tends to become located in said region, and delivering treatment fluid to the ends of any extended arm from which the fluid is applied to a breakout region in order to stabilise the breakout region.

13. The method of claim 12 carried out during drilling.

14. The method of claim 12 wherein the treatment fluid is a chemical resin or gel.

* * * * *